US010000830B2

(12) United States Patent
Abe et al.

(10) Patent No.: US 10,000,830 B2
(45) Date of Patent: Jun. 19, 2018

(54) METHOD FOR MANUFACTURING MARTENSITE-BASED PRECIPITATION STRENGTHENING STAINLESS STEEL

(71) Applicant: HITACHI METALS, LTD., Tokyo (JP)

(72) Inventors: Ryutaro Abe, Shimane (JP); Tomonori Ueno, Shimane (JP); Eiji Shimohira, Shimane (JP); Gang Han, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 0 days. days.

(21) Appl. No.: 15/512,212

(22) PCT Filed: Sep. 28, 2015

(86) PCT No.: PCT/JP2015/077324
§ 371 (c)(1),
(2) Date: Mar. 17, 2017

(87) PCT Pub. No.: WO2016/052403
PCT Pub. Date: Apr. 7, 2016

(65) Prior Publication Data

US 2017/0275743 A1 Sep. 28, 2017

(30) Foreign Application Priority Data

Sep. 29, 2014 (JP) ..... 2014-199309

(51) Int. Cl.

| | |
|---|---|
| ***C21D 9/00*** | (2006.01) |
| ***C21D 6/00*** | (2006.01) |
| ***C21D 6/02*** | (2006.01) |
| ***C21D 6/04*** | (2006.01) |
| ***C22C 38/44*** | (2006.01) |

(52) U.S. Cl.
CPC ..... *C22C 38/44* (2013.01); *C21D 6/004* (2013.01); *C21D 6/04* (2013.01)

(58) Field of Classification Search
None
See application file for complete search history.

(56) References Cited

U.S. PATENT DOCUMENTS

| | | | |
|---|---|---|---|
| 2006/0118215 | A1 | 6/2006 | Hiroharu |
| 2014/0105753 | A1 | 4/2014 | Oikawa |
| 2015/0299831 | A1 | 10/2015 | Tomonori |
| 2015/0315921 | A1 | 11/2015 | Hiroharu |

FOREIGN PATENT DOCUMENTS

| | | | | | |
|---|---|---|---|---|---|
| EP | 2722407 | A2 | | 4/2014 | |
| EP | 2927337 | A1 | | 10/2015 | |
| GB | 988452 | A | | 4/1965 | |
| JP | 58-052418 | | * | 3/1983 | ..... C21D 6/00 |
| JP | 59150017 | A2 | | 8/1984 | |
| JP | 2005194626 | A2 | | 7/2005 | |
| JP | 2006348339 | A2 | | 12/2006 | |
| JP | 2013-170558 | | * | 2/2013 | ..... F01D 5/28 |
| JP | 5574283 | B1 | | 8/2014 | |
| WO | 2014050698 | A1 | | 4/2014 | |

OTHER PUBLICATIONS

Machine-English translation of JP 58-052418, Sato Shinji et al, Mar. 28, 1983.*
Machine-English translation of JP 2013-170558, Arai Masahiko et al., Feb. 23, 2013.*
International Search Report dated Dec. 8, 2015 filed in PCT/JP2015/077324.
First & Sole Office Action dated May 20, 2016 for the corresponding Japanese Patent Application No. 2016-501483.
Extended European Search Report dated Sep. 11, 2017 for the corresponding European Patent Application No. 15845709.3.

* cited by examiner

*Primary Examiner* — Deborah Yee
(74) *Attorney, Agent, or Firm* — Rankin, Hill & Clark LLP

(57) ABSTRACT

The present invention is to provide a method for manufacturing a martensite-based precipitation strengthening stainless steel, which effectively enables crystal grains to become finer by improving a solution treatment method. The method for manufacturing a martensite-based precipitation strengthening stainless steel containing 0.01 to 0.05 mass % of C, 0.2 mass % or less of Si, 0.4 mass % or less of Mn, 7.5 to 11.0 mass % of Ni, 10.5 to 14.5 mass % of Cr, 1.75 to 2.50 mass % of Mo, 0.9 to 2.0 mass % of Al, less than 0.2 mass % of Ti, and Fe and impurities as a remainder, which is provided by the present invention, includes performing a solid solution treatment at 845 to 895° C. once or more.

3 Claims, No Drawings

METHOD FOR MANUFACTURING MARTENSITE-BASED PRECIPITATION STRENGTHENING STAINLESS STEEL

TECHNICAL FIELD

The present invention relates to a method for manufacturing a martensite-based precipitation strengthening stainless steel.

BACKGROUND ART

In turbine components for power generation and aircraft body components, an iron-based alloy having high strength has been used. For example, in the turbine components for power generation, a high Cr steel is used in various components.

In a low-pressure final-stage rotor blade for steam turbines which is particularly required to have strength among the turbine components, a 12Cr steel containing approximately 12 weight % of Cr is used as an alloy having all of strength, oxidation resistance and corrosion resistance. In order to improve power generation efficiency, a longer blade length is advantageous. However, due to the limitation of strength, the limit of the blade length of a 12Cr steel is approximately 1 meter.

Also, there are known low alloy-based high tensile steels such as AISI 4340 and 300M. These alloys are low-alloy steels which can have a tensile strength of a 1800 MPa class and an elongation of approximately 10%. However, the amount of Cr which contributes to corrosion resistance and oxidation resistance is as small as approximately 1%. Therefore, the low-alloy steels cannot be used as a rotor blade for steam turbines. In aircraft uses, there is also often used an alloy which has been subjected to a surface treatment such as plating for the purpose of preventing corrosion caused by, for example, a salt content in the atmosphere.

On the other hand, as an alloy having all of strength, corrosion resistance and oxidation resistance, there is known a high strength stainless steel. As a representative alloy of the high strength stainless steel, there is known a martensite-based precipitation strengthening stainless steel such as PH13-8Mo (PATENT LITERATURE 1).

In this martensite-based precipitation strengthening stainless steel, fine precipitates are dispersed and precipitated in a quenched martensite structure. Accordingly, higher strength can be obtained compared to a quenching-tempering type 12Cr steel. Also, in general, there is contained 10% or more of Cr which contributes to corrosion resistance. Therefore, the martensite-based precipitation strengthening stainless steel is excellent in corrosion resistance and oxidation resistance compared to low-alloy steels.

CITATION LIST

Patent Literature

PATENT LITERATURE 1: JP-A-2005-194626

SUMMARY OF THE INVENTION

Problems to be Solved by the Invention

In general, metal, not only the martensite-based precipitation strengthening stainless steel, has higher strength and toughness as crystal grains become finer. When the elongation and enlargement of steam turbine rotor blades or the application to aircraft uses are considered, further higher strength and toughness are required. Therefore, the problem is to efficiently obtain finer crystal grains.

However, the crystal grain size of the size obtained by a conventional heat treatment method is approximately 6 at most in terms of the ASTM crystal grain size number. It is estimated that this level of crystal grain size is not enough to achieve high strength and high toughness which will be required in the future.

An object of the present invention is to provide a method for manufacturing a martensite-based precipitation strengthening stainless steel, which effectively enables crystal grains to become finer by improving a solution treatment method.

Solution to the Problems

The present inventor studied an effect by the condition of a solid solution treatment on the crystal grain size, in order to balance between the strength properties and the toughness of a martensite-based precipitation strengthening stainless steel. As a result, the present inventor found that performing a solid solution treatment at temperatures within a specific range efficiently enables crystal grains to become finer.

That is, in a method, according to the present invention, for manufacturing a martensite-based precipitation strengthening stainless steel which contains 0.01 to 0.05 mass % of C, 0.2 mass % or less of Si, 0.4 mass % or less of Mn, 7.5 to 11.0 mass % of Ni, 10.5 to 14.5 mass % of Cr, 1.75 to 2.50 mass % of Mo, 0.9 to 2.0 mass % of Al, less than 0.2 mass % of Ti, and Fe and impurities as a remainder, a solid solution treatment at 845 to 895° C. is performed once or more.

In the preferable method for manufacturing the martensite-based precipitation strengthening stainless steel, the solid solution treatment is performed multiple times.

In the further preferable method for manufacturing the martensite-based precipitation strengthening stainless steel, an aging treatment at 500 to 600° C. is performed after the solid solution treatment.

In the further more preferable method for manufacturing the martensite-based precipitation strengthening stainless steel, the crystal grain size number after the solid solution treatment is 7 or more.

Effects of the Invention

According to the present invention, the crystal grains of the martensite-based precipitation strengthening stainless steel can effectively become finer by a solution treatment. Therefore, there can be expected improvement of the strength and the toughness of the martensite-based precipitation strengthening stainless steel. For example, it is expected that the use of the martensite-based precipitation strengthening stainless steel in a turbine component for power generation improves power generation efficiency. Also, the use of the martensite-based precipitation strengthening stainless steel as an aircraft component can contribute to weight reduction of an aircraft body.

DESCRIPTION OF THE EMBODIMENTS

The largest feature of the present invention is that performing a solid solution treatment at temperatures within a specific range once or more efficiently enables crystal grains to become finer. Hereinafter, the present invention will be described in detail.

First, the alloy composition defined in the present invention will be described. All of the chemical ingredients are expressed in terms of mass %.

<C: 0.01 to 0.05>

C is an element which is important for the precipitation strengthening and the control of crystal grains with carbides. Therefore, 0.01% or more of C is necessary for obtaining the above-described effects. On the other hand, when C combines with Cr to form a carbide, the amount of Cr in a matrix phase decreases, and corrosion resistance deteriorates. Also, C is likely to also combine with Ti to form a carbide. In this case, Ti, which originally forms an intermetallic compound phase to contribute to precipitation strengthening, becomes a carbide having less contribution to strengthening. For this reason, the strength properties deteriorate. Thus, the upper limit of C is 0.05%.

<Si: 0.2% or Less>

Si can be added during manufacture as a deoxidizing element. When Si exceeds 0.2%, an embrittled phase which causes the strength of an alloy to decrease is likely to be precipitated. For this reason, the upper limit of Si is 0.2%. For example, when a deoxidizing element in place of Si is added, there is no problem even if Si is 0%.

<Mn: 0.4% or Less>

Mn has a deoxidizing effect in a similar manner to Si, and can be therefore added during manufacture. When Mn exceeds 0.4%, forging properties at high temperature deteriorate. For this reason, the upper limit of Mn is 0.4%. For example, when a deoxidizing element in place of Mn is added, there is no problem even if Mn is 0%.

<Ni: 7.5 to 11.0%>

Ni combines with Al or Ti described later to form an intermetallic compound which contributes to strengthening. Therefore, Ni is an element which is indispensable for improving the strength of an alloy. Also, Ni is solved in a matrix phase, and has the effect of improving the toughness of an alloy. In order to form a precipitate and maintain the toughness of a matrix phase by adding Ni, at least 7.5% or more of Ni are necessary. Ni also has the effect of stabilizing austenite and lowering the martensitic transformation temperature. Therefore, excess addition of Ni causes martensitic transformation to become insufficient. As a result, the retained austenite content increases, and the strength of an alloy decreases. For this reason, the upper limit of Ni is 11.0%. It is noted that for further surely obtaining the effect of Ni addition, the lower limit of Ni is preferably 7.75%, and further preferably 8.0%. Also, the upper limit of Ni is preferably 10.5%, and further preferably 9.5%.

<Cr: 10.5 to 14.5%>

Cr is an element which is indispensable for improving the corrosion resistance and the oxidation resistance of an alloy. When Cr is less than 10.5%, the alloy cannot have sufficient corrosion resistance and oxidation resistance. For this reason, the lower limit is 10.5%. Also, Cr has the effect of lowering martensitic transformation temperature, in a similar manner to Ni. Excess addition of Cr causes the retained austenite content to increase or the strength attributable to the precipitation of a δ ferrite phase to decrease. For this reason, the upper limit is 14.5%. It is noted that for further surely obtaining the effect of Cr addition, the lower limit of Cr is preferably 11.0%, and further preferably 11.8%. Also, the upper limit of Cr is preferably 13.25%, and further preferably 13.0%.

<Mo: 1.75 to 2.50%>

Mo is solved in a matrix phase, and contributes to the solving and strengthening of a base material. At the same time, Mo contributes to the improvement of corrosion resistance. For this reason, Mo is always added. When Mo is less than 1.75%, the strength of a matrix phase to a precipitation strengthening phase is insufficient. Accordingly, the ductility and the toughness of an alloy decrease. On the other hand, excess addition of Mo causes the increase of the retained austenite content attributable to the decrease in martensite temperature and the precipitation of a δ ferrite phase. Accordingly, the strength decreases. For this reason, the upper limit of Mo is 2.50%. It is noted that for further surely obtaining the effect of Mo addition, the lower limit of Mo is preferably 1.90%, and further preferably 2.00%. Also, the upper limit of Mo is preferably 2.40%, and further preferably 2.30%.

<Al: 0.9 to 2.0%>

According to the present invention, Al is an element which is indispensable for improving the strength. Al combines with Ni to form an intermetallic compound. The formed intermetallic compound is finely precipitated in a martensite structure. Accordingly, high strength properties are obtained. In order to obtain a precipitation amount required for strengthening, 0.9% or more of Al is necessary to be added. On the other hand, excess addition of Al causes the precipitation amount of the intermetallic compound to become excessive. Accordingly, the Ni content in a matrix phase decreases, and the toughness decreases. For this reason, the upper limit of Al is 2.0%. It is noted that for further surely obtaining the effect of Al addition, the lower limit of Al is preferably 1.0%, and further preferably 1.1%. Also, the upper limit of Al is preferably 1.7%, and further preferably 1.5%.

<Ti: less than 0.2%>

Ti is, similarly to Al, an element which has the effect of forming a precipitate to improve the strength of an alloy. However, Ti forms a stable carbide. Therefore, Ti does not necessarily need to be added in the present invention. There is no problem even if Ti is 0% (not added).

<Fe and Impurities as Remainder>

The remainder is Fe, and an impurity element which is unavoidably mixed in during manufacture. Examples of a representative impurity element may include S, P, and N. The amounts of these elements may be required to be small. However, there is no problem when the amount of each element is 0.05% or less, as an amount to which each element can be decreased during the manufacture in common facilities.

In the present invention, the martensite-based precipitation strengthening stainless steel having the above-described composition is used as a material to be subjected to a solid solution treatment, for performing a solid solution treatment. It is noted that the shape of the material to be subjected to a solid solution treatment is particularly not limited. This material to be subjected to a solid solution treatment may be an intermediate material such as a steel piece, a crude processing material having a crude processing shape before final processing is performed to a product, or the like.

<Solid Solution Treatment>

Usually, the martensite-based precipitation strengthening stainless steel has practically a two-stage heat treatment process in many cases. The first heat treatment is a solid solution treatment. The second heat treatment is an aging treatment. An object of the above-described solid solution treatment is to solve a precipitation strengthening element in an austenite phase and thereafter rapidly cool the austenite phase with water, oil, cooling gas, or the like, so that the austenite phase is transformed into a martensite phase. Usually, the solid solution treatment temperature during the solid solution treatment tends to be set rather high in consideration of the solving of the precipitation strengthening element. In general, a solid solution treatment is performed at 920° C. or higher.

On the other hand, a main object of the solid solution treatment of the invention according to the present application is to adjust crystal grains. In the present invention, there is employed a solid solution treatment which is performed at temperatures of 845 to 895° C. which are relatively lower than in the conventional treatment. This allows a sound martensite structure to be generated, and furthermore, crystal grains to become finer.

The temperature range of 845 to 895° C. corresponds to the solution temperature of a carbide. The recrystallization of austenite proceeds after the solving of a carbide. Therefore, crystal grains can become finer by promoting the recrystallization. When the temperature range for the solid solution treatment is lower than 845° C., a carbide does not solve. Therefore, recrystallization does not proceed. For this reason, crystal grains do not become finer. On the other hand, although increase of the solution temperature is advantageous for the occurrence of recrystallization, the growth of recrystallized grains also becomes significant. At temperatures higher than 895° C., the growth of grains becomes dominant, and crystal grains are coarsened. Thus, the effect of obtaining finer crystal grains is impaired. For this reason, the temperature during the solid solution treatment is 845 to 895° C. in the present invention. The lower limit of the temperature during the solid solution treatment is preferably 850° C., and further preferably 860° C. Also, the upper limit of the temperature during the solid solution treatment is preferably 890° C., and further preferably 885° C.

It is noted that the retention time during the solid solution treatment is preferably selected from the range of 0.5 to 3 hours. When the retention time is less than 0.5 hours, the solution process of a carbide is not completed. Therefore, the structure is likely to become non-uniform. On the other hand, when the process time reaches 3 hours, the solution of a carbide is sufficiently completed. Therefore, the solid solution treatment for an extended period of 3 hours or more leads to reduction in production efficiency. By selecting such appropriate temperature and time for the solid solution treatment, the crystal grain diameter after the solid solution treatment becomes 7 or more in terms of the crystal grain size number. For example, an excessively short retention time causes the solution of an alloy element to be insufficient. Therefore, sufficient precipitation strengthening may not be obtained by a subsequent aging. On the other hand, an excessively long retention time may cause crystal grains to be coarsened. Also, the excessively coarsened crystal grains may cause the properties of the martensite-based precipitation strengthening stainless steel to decrease. By selecting such appropriate temperature and time for the solid solution treatment, the crystals of the martensite-based precipitation strengthening stainless steel after the solid solution treatment can become fine grains having a grain diameter of 7 or more in terms of the ASTM crystal grain size number.

In order to more surely enable crystal grains to become finer in the present invention, the above-described solid solution treatment is preferably repeated multiple times. A structure which has been transformed into martensite by cooling after the solid solution treatment stores strain inside the structure by the volume change attributable to the transformation. When the solid solution treatment is performed again, the strain is released, and recrystallization also proceeds. Accordingly, crystal grains become finer. Thereafter, strain is stored inside again during the martensitic transformation at cooling. For this reason, when the solid solution treatment is repeated, crystal grains gradually become finer. It is noted that when the solid solution treatment is repeated five times or more, the significant effect of enabling crystal grains to become finer is gradually saturated. Accordingly, productivity is worsened instead. For this reason, the upper limit of the number of solid solution treatments to be repeated is preferably 4 times.

It is noted that there is no problem if a different temperature is selected for the solid solution treatment which is repeated multiple times, as long as it is within the temperature range of 845 to 895° C.

<Sub-Zero Treatment>

In the martensite-based precipitation strengthening stainless steel which is defined in the present invention, the martensitic transformation temperature is low depending on the ingredients of an alloy. Accordingly, there is a possibility that the transformation does not sufficiently occur only by the cooling during the solid solution treatment. For this reason, austenite may be retained, and proof stress may decrease. In such a case, a sub-zero treatment can be further performed after the cooling to room temperature in the solid solution treatment. Temperatures of −50 to −100° C. are sufficient as a treatment temperature during the sub-zero treatment. As a treatment time, for example, 0.5 to 3 hours are sufficient. Also, when the sub-zero treatment is performed, it is preferably performed within 24 hours after the last solid solution treatment has been performed. After 24 hours has passed since the last solid solution treatment was performed, austenite is stabilized. Accordingly, there is a risk that the progress of the martensitic transformation by the sub-zero treatment may become difficult. Performing the sub-zero treatment enables retained austenite to be reduced, and mechanical properties such as proof stress to be improved.

<Aging Treatment>

After the above-described solid solution treatment or the above-described sub-zero treatment, an aging treatment for precipitation strengthening can be performed. When the aging treatment temperature is excessively low, precipitation is insufficient, and high strength cannot be obtained. On the other hand, when the aging treatment temperature is excessively high, coarse precipitates are formed, and sufficient strength cannot be obtained as well. Therefore, the aging treatment temperature is preferably 500 to 600° C. The aging treatment time can be selected from the range of 1 to 24 hours.

It is noted that when the solid solution treatment has been performed multiple times, the aging treatment is performed after the last solid solution treatment has been performed.

EXAMPLES

Example 1

The present invention will be described in further detail by referring to the following examples.

One ton of a steel ingot manufactured by vacuum induction melting and vacuum arc remelting was hot forged into a round bar having a diameter of 220 mm, thereby to prepare a forging stock (steel piece). The ingredients of the melted steel ingot are indicated in Table 1.

TABLE 1

| C | Si | Mn | Ni | Cr | Mo | Al | Ti | (mass %) Remainder |
|---|---|---|---|---|---|---|---|---|
| 0.029 | 0.02 | 0.02 | 8.20 | 12.75 | 2.20 | 1.20 | 0.003 | Fe and unavoidable impurities |

A solid solution treatment was performed once in which a test piece sampled from the forging stock was retained at an optional temperature within the range of 800 to 927° C. for 1 hour, and thereafter oil cooling was performed. Furthermore, a sub-zero treatment of −75° C.×2 hours was performed. Thereafter, the crystal grain size was measured. Test No. 4 corresponds to an example of the present invention, and others correspond to comparative examples. All of the results are indicated in Table 2. In Test No. 1, the grain size of the forging stock itself was measured. It is noted that the crystal grain size number was measured by the method defined in ASTM-E112. The numerical values indicated in Table 2 are crystal grain size numbers.

TABLE 2

| Test No. | Condition of solid solution treatment | Sub-zero treatment | Crystal grain size | Remarks |
|---|---|---|---|---|
| 1 | None | None | 5.9 | Comparative example |
| 2 | 800° C. × 1 h oil cooling | −75° C. × 2 h | 5.6 | Comparative example |
| 3 | 840° C. × 1 h oil cooling | −75° C. × 2 h | 6.4 | Comparative example |
| 4 | 880° C. × 1 h oil cooling | −75° C. × 2 h | 8.0 | Present invention |
| 5 | 927° C. × 1 h oil cooling | −75° C. × 2 h | 6.0 | Comparative example |

As indicated in and understood from Table 2, only the test piece (No. 4) to which the method for manufacturing the present invention was applied contained fine grains having an ASTM crystal grain size number of 8.0. On the other hand, the test pieces to which a method other than the manufacturing method defined by the present invention was applied contained coarse crystal grains having an ASTM crystal grain size number of 5.6 to 6.4.

Example 2

A test piece sampled from the forging stock described above in Example 1 was retained at an optional temperature within the range of 850 to 955° C. for 1 hour. Thereafter, a solid solution treatment was performed once or more in which the test piece was subjected to oil cooling. The temperature and time for the solid solution treatment which was repeated multiple times were not changed. Test Nos. 8 to 12 were subjected to a sub-zero treatment of −75° C.×2 h for each solid solution treatment. Test Nos. 6 to 12 correspond to examples of the present invention, and others correspond to comparative examples. All of the results are indicated in Table 3. It is noted that the crystal grain size number was measured by the method defined in ASTM-E112. The numerical values indicated in Table 3 are crystal grain size numbers.

TABLE 3

| Test No. | Condition of solid solution treatment | Sub-zero treatment | The number of solid solution treatments | Crystal grain size | Remarks |
|---|---|---|---|---|---|
| 1 | None | None | — | 5.9 | Comparative example |
| 6 | 850° C. × 1 h oil cooling | None | 2 | 7.4 | Present invention |
| 7 | 850° C. × 1 h oil cooling | None | 3 | 8.0 | Present invention |
| 8 | 880° C. × 1 h oil cooling | −75° C. × 2 h | 1 | 8.0 | Present invention |
| 9 | 880° C. × 1 h oil cooling | −75° C. × 2 h | 2 | 8.2 | Present invention |
| 10 | 880° C. × 1 h oil cooling | −75° C. × 2 h | 3 | 8.7 | Present invention |
| 11 | 880° C. × 1 h oil cooling | −75° C. × 2 h | 4 | 9.1 | Present invention |
| 12 | 880° C. × 1 h oil cooling | −75° C. × 2 h | 5 | 9.1 | Present invention |
| 13 | 955° C. × 1 h oil cooling | None | 1 | 6.9 | Comparative example |
| 14 | 955° C. × 1 h oil cooling | None | 2 | 6.2 | Comparative example |
| 15 | 955° C. × 1 h oil cooling | None | 3 | 6.4 | Comparative example |

As indicated in and understood from Table 3, only the test pieces (Nos. 6 to 12) to which the method for manufacturing the present invention was applied contain fine grains having an ASTM crystal grain size number of 7.0 or more. On the other hand, in the test pieces to which a method other than the manufacturing method defined by the present invention was applied, fine grains having an ASTM crystal grain size number of down to 7.0 were not generated.

Also, as understood from Nos. 6 to 7 and Nos. 8 to 12 of the present invention, the crystal grains become finer as the solid solution treatment is repeated more times. Also, it is understood that every time the solid solution treatment is repeated at solid solution treatment temperatures of 850° C. and 880° C., the crystal grains become finer.

Example 3

There was prepared a forging stock (steel piece) for a martensite-based precipitation strengthening stainless steel, which has ingredients different from that of the martensite-based precipitation strengthening stainless steel indicated in Table 1. The ingredients are indicated in Table 4.

TABLE 4

| C | Si | Mn | Ni | Cr | Mo | Al | Ti | (mass %) Remainder |
|---|---|---|---|---|---|---|---|---|
| 0.045 | 0.02 | 0.02 | 8.15 | 12.33 | 2.13 | 1.21 | 0.003 | Fe and unavoidable impurities |

A solid solution treatment was performed once which includes performing water cooling after a test piece sampled from the forging stock has been retained at a temperature of 880° C. for 1 hour. Furthermore, a sub-zero treatment of −75° C.×2 hours was performed. Thereafter, an aging treatment of 524° C.×8 h was performed. The material having been subjected to these treatments was measured for its crystal grain size. All of the results are indicated in Table 5. It is noted that the crystal grain size number was measured by the method defined in ASTM-E112. The numerical values indicated in Table 5 are crystal grain size numbers.

TABLE 5

| Test No. | Condition of solid solution treatment | Sub-zero treatment | Crystal grain size | Remarks |
|---|---|---|---|---|
| 1 | None | None | 5.8 | Comparative example |
| 16 | 880° C. × 1 h oil cooling | −75° C. × 2 h | 8.5 | Present invention |

As indicated in and understood from Table 5, when the method for manufacturing the present invention is applied, fine grains having an ASTM crystal grain size number of 8.0 or more are generated.

As understood from the above-described results, the crystal grains of the martensite-based precipitation strengthening stainless steel according to the present invention become effectively finer. Accordingly, it is expected that the martensite-based precipitation strengthening stainless steel according to the present invention has higher strength and higher toughness. Thus, when the martensite-based precipitation strengthening stainless steel according to the present invention is used in a turbine component for power generation, the improvement of efficiency can be expected. Also, when the martensite-based precipitation strengthening stainless steel according to the present invention is used as an aircraft component, contribution to weight reduction of an aircraft body is possible.

The invention claimed is:

1. A method for manufacturing a martensite-based precipitation strengthening stainless steel which contains 0.01 to 0.05 mass of C, 0.2 mass or less of Si, 0.4 mass or less of Mn, 7.5 to 11.0 mass of Ni, 10.5 to 14.5 mass of Cr, 1.75 to 2.50 mass of Mo, 0.9 to 2.0 mass of Al, less than 0.2 mass of Ti, and Fe and impurities as a remainder, wherein by performing a solid solution treatment at temperatures within a range of 845 to 895° C. for 0.5 to 3 hours multiple times, a crystal grain size number after the solid solution treatment becomes 7 or more, the crystal grain size number being measured by a method defined in ASTM-E112, and all of the solid solution treatments are performed at temperatures within the range of 845 to 895° C.

2. The method for manufacturing the martensite-based precipitation strengthening stainless steel according to claim 1, wherein an aging treatment at 500 to 600° C. is performed for 1 to 24 hours after the last solid solution treatment is performed.

3. The method for manufacturing the martensite-based precipitation strengthening stainless steel according to claim 2, wherein a sub-zero treatment is performed at temperatures within a range of −50 to −100° C. within 24 hours after the last solid solution treatment is performed and before the aging treatment.

* * * * *